US007055348B1

(12) United States Patent
Wei

(10) Patent No.: US 7,055,348 B1
(45) Date of Patent: Jun. 6, 2006

(54) HIGH SPEED COLOR ALTERING HEAD FOR SINGLE-FACE CIRCULAR KNITTING MACHINES

(75) Inventor: Chih-Liang Wei, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/269,687

(22) Filed: Nov. 9, 2005

(51) Int. Cl.
*D04B 15/58* (2006.01)

(52) U.S. Cl. ..... 66/140 R; 66/134

(58) Field of Classification Search ..... 66/134, 66/140 R, 133, 135, 138, 139, 140 S, 141–144, 66/145 R
See application file for complete search history.

(56) References Cited

U.S. PATENT DOCUMENTS 4,656,842 A * 4/1987 Sawazaki et al. ..... 66/139
5,070,709 A * 12/1991 Guell ..... 66/140 R
5,218,845 A * 6/1993 Wang ..... 66/139
6,000,245 A * 12/1999 Plath et al. ..... 66/139
6,058,742 A * 5/2000 Dalmau Guell ..... 66/140 R
6,408,655 B1 * 6/2002 Ossensi et al. ..... 66/140 R
6,655,176 B1 * 12/2003 Wang ..... 66/140 R

* cited by examiner

*Primary Examiner*—Danny Worrell
(74) *Attorney, Agent, or Firm*—Birch, Stewart, Kolasch & Birch, LLP

(57) ABSTRACT

A high speed color altering head for single-face circular knitting machines is installed on a circular knitting machine and controlled by a return cam, a needle selection device and upper and lower cams to perform colored yarns feeding operation for knitting needles to achieve colored and jacquard knitting effect. The color altering head includes two outer plates, a plurality of yarn feeding mechanisms, a plurality of yarn clipping mechanisms, a plurality of spacers and a plurality of color selection pressing plates. The needle selection device drives the color selection pressing plates to release the corresponding yarn feeding mechanisms and yarn clipping mechanisms so that the upper and lower cams of the circular knitting machine can control yarn feeding and yarn clipping operations at high speed without dropping the yarns.

9 Claims, 10 Drawing Sheets

HIGH SPEED COLOR ALTERING HEAD FOR SINGLE-FACE CIRCULAR KNITTING MACHINES

FIELD OF THE INVENTION

The present invention relates to a color altering head for circular knitting machines and particularly to a high speed color altering head for single-face circular knitting machines to feed colored yarns.

BACKGROUND OF THE INVENTION

During knitting operation of a conventional circular knitting machine, if there is a need to do jacquard knitting of different colors on the fabric, a color altering head is installed on a yarn feeding bore of the circular knitting machine. The color altering head can move a color yarn to the yarn feeding bore to be picked up by a knitting needle so that the colored yarn is knitted into the fabric to achieve jacquard knitting effect that contains different colors.

Refer to FIGS. 1A through 1D for a fragmentary structure of a conventional single-face color altering head in operations. The single-face color altering head mechanism 1 includes a yarn feeding plate 11, a yarn clipping plate 12 and a spacer 13. The yarn feeding plate 11 has a butt 112 driven by a cam (not shown in the drawings) of the circular knitting machine to push the yarn feeding plate 11 forwards (referring to FIG. 1A). A colored yarn threading through a yarn feeding eye 116 is picked up by the yarn clipping plate 12 and clipped between the yarn clipping plate 12 and the spacer 13, and can be drawn (not shown in the drawings). While the yarn feeding plate 11 is moved and a thrust portion 114 of the yarn feeding plate 11 is in contact with a thrust lug 122 of the yarn clipping plate 12, the yarn clipping plate 12 is driven forwards by the yarn feeding plate 11 (referring to FIG. 1B). Then the color yarn clipped between the yarn clipping plate 12 and the spacer 13 is released to be knitted by the knitting needle of the circular knitting machine. When the needle selection device (not shown in the drawings) of the circular knitting machine changes another colored yarn, another set of yarn feeding plate and yarn clipping plate (not shown in the drawings) operate as previously discussed to pick up and release another color yarn for knitting operation. Meanwhile, the yarn feeding plate 11 is immediately driven by the cam (not shown in the drawings) to retract the yarn feeding plate 11 through a drawing portion 113 formed thereon (referring to FIG. 1C), and the colored yarn threading through the yarn feeding eye 116 is picked up by the yarn feeding plate 11, and the yarn is moved along the path of an action slot 111 to be transversely saddled on a yarn clipping portion 121 (not shown in the drawings) of the yarn clipping plate 12. When the yarn feeding plate 11 is moved and a retracting portion 115 thereof is in contact with a retracting lug 123 of the yarn clipping plate 12, the yarn clipping plate 12 is retracted by a reward driven force of the yarn feeding plate 11 (referring to FIG. 1D). As the color yarn is transversely saddled on the clipping portion 121 (not shown in the drawings), the yarn clipping plate 12 is moved rewards to the spacer 13 by the yarn feeding plate 11, and a shearing force is generated to sever the colored yarn and clip the colored yarn between the yarn clipping plate 12 and the spacer 13. Thereby different colored yarns can be changed in the knitting operation, and the resulting knitted fabric has colorful jacquard effect.

However, the conventional color altering head previously discussed mainly aims to be used in the circular knitting machine operating at a regular speed to place the altered yarn transversely on the clipping portion 121, and generate a shearing force with the spacer 13 to sever the yarn, and clip the yarn between the yarn clipping plate 12 and the spacer 13. When the conventional color altering head is used at high speed (about 25 RPM), two serious problems occur: 1. During operation of the yarn feeding plate 11, an extra action of driving the yarn clipping plate 12 is needed. Hence operation cycle is longer, and high speed knitting operation is hindered. Moreover, the constant driving of the yarn clipping plate 12 and the associated hitting generate metal impact and bouncing. This also impairs high speed operation. 2. As the yarn clipping plate 12 is driven by the yarn feeding plate 11 at a selected operation speed, the color altering head also has to be designed and function at the selected operation speed. In the event that the circular knitting machine runs at an operation speed higher than the designed level, the yarn cannot be straddled on the clipping portion 121 or the clipping portion 121 cannot clip the severed yarn, yarn dropping occurs.

SUMMARY OF THE INVENTION

Therefore the primary object of the present invention is to solve the aforesaid shortcomings. The present invention provides an improved color altering head that separately controls the yarn feeding plate and the yarn clipping plate. Each has its own operation. There is no extra driving operation. Hence operation speed can increase. There is also no metal bouncing force. This can facilitate high speed operation.

Another object of the invention is to provide an improved color altering head which is adaptable to circular knitting machines of varying operation speeds. By changing the control sequence of the cams, the color altering head can function as desired at different operation speeds of the circular knitting machines. The yarn can be severed smoothly, and yarn dropping can be prevented.

In order to achieve the foregoing objects, the high speed color altering head for single-face knitting machines according to the invention includes: two outer plates on two outer sides of the color altering head;

a plurality of yarn feeding mechanisms located between the two outer plates to provide colored yarn feeding operation;

a plurality of yarn clipping mechanisms located between the two outer plates alternately among the yarn feeding mechanisms to clip and sever colored yarns;

a plurality of spacers located on the plates and yarn feeding mechanisms; and a plurality of color selection pressing plates located between the two outer plates. Each color selection pressing plate corresponds to one yarn feeding mechanism and one yarn clipping mechanism.

The color selection pressing plate is driven by a needle selection device to release the corresponding yarn feeding mechanism and yarn clipping mechanism to enable the upper and lower cams of the circular knitting machine to separately control yarn feeding operation of the yarn feeding mechanism and yarn clipping operation of the yarn clipping mechanism. Thereby high speed operation can be achieved without dropping the yarns.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
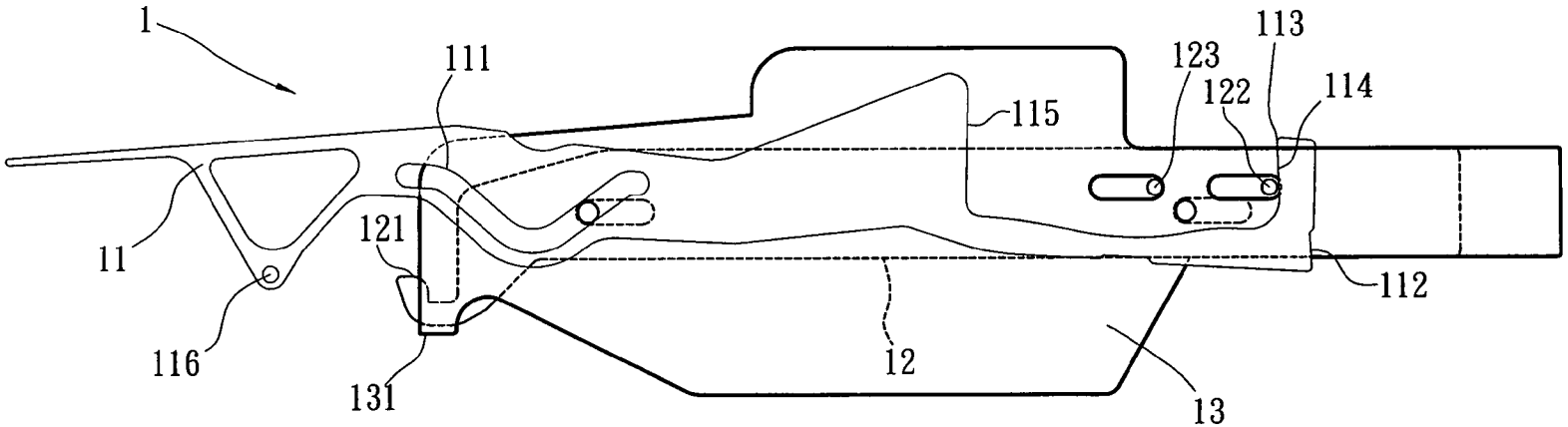
Fig. 1A PRIOR ART
FIGS. 1A through 1D are fragmentary views of a conventional single-face color altering head in operating conditions.
Figure 1B:
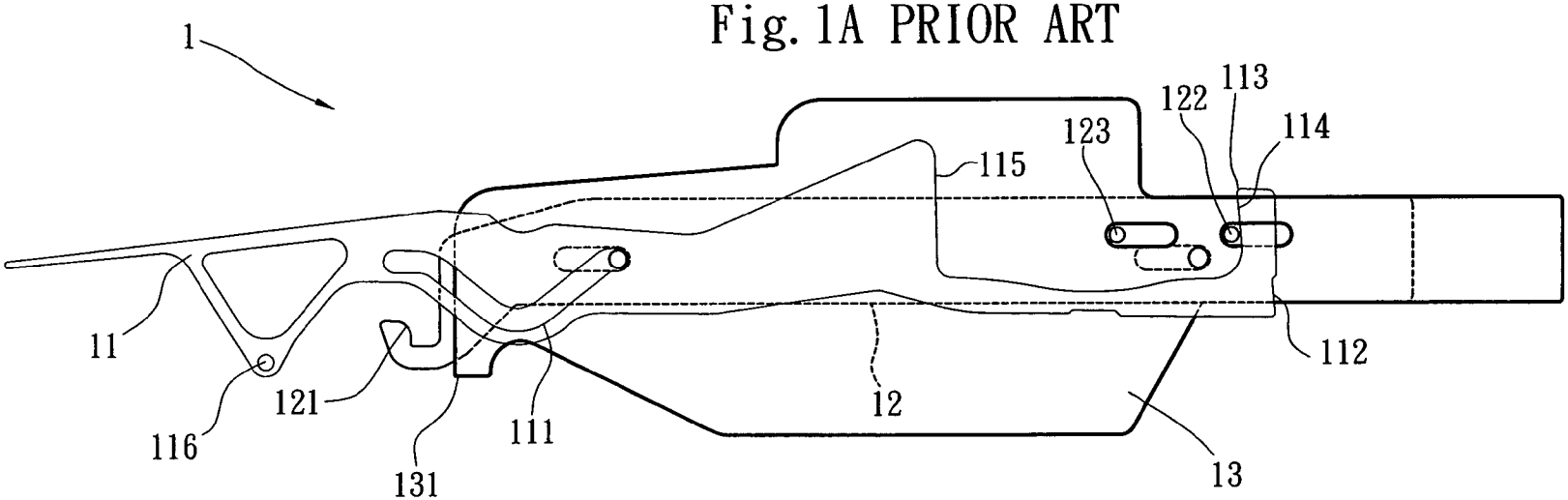
Fig. 1B PRIOR ART
Figure 1C:
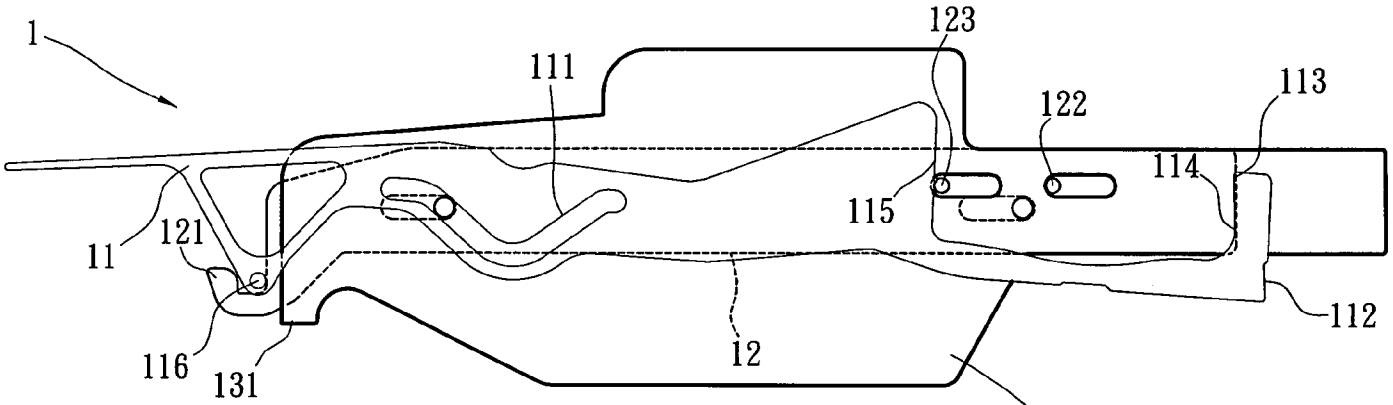
Fig. 1C PRIOR ART
Figure 1D:
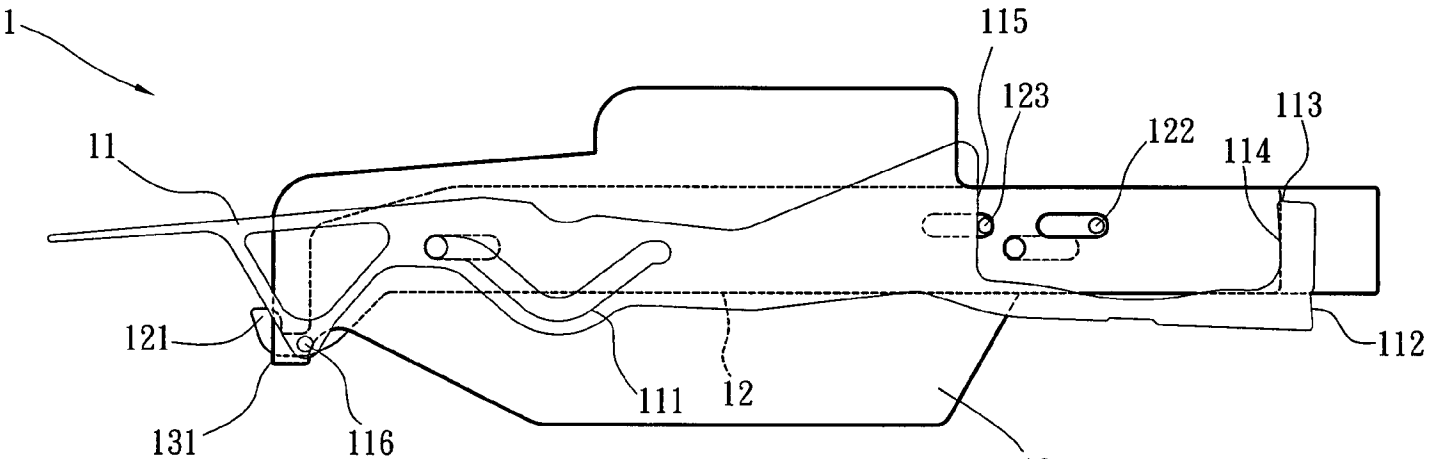
Fig. 1D PRIOR ART
Figure 2:
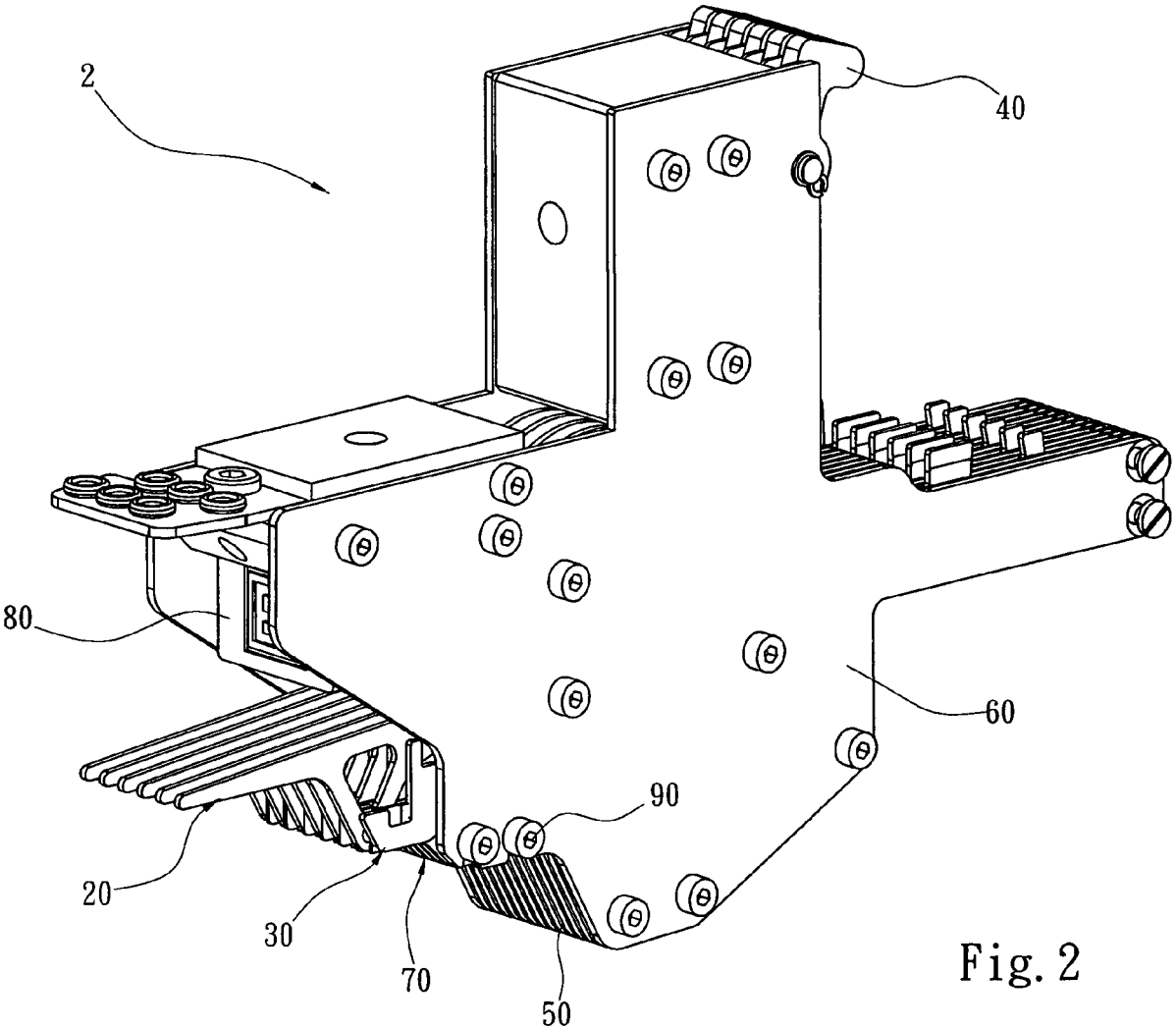
FIG. 2 is a perspective view of the color altering head of the present invention.

Please referring to FIG. 2, the high speed color altering head 2 for single-face circular knitting machines according to the invention is installed on a circular knitting machine and controlled by a return cam, a needle selection device and upper and lower cams (not shown in the drawings) of the circular knitting machine to feed colored yarns to a knitting needle and perform colored and jacquard knitting operation. The color altering head 2 includes two outer plates 60 located on two outer sides, a plurality of yarn feeding mechanism 20 located between the two outer plates 60 to perform colored yarn feeding operation, a plurality of yarn clipping mechanism 30 located between the two outer plates 60 among the yarn feeding mechanisms 20 in an alternate fashion to clip and sever colored yarns, a plurality of spacers 50 located between the outer plates 60, yarn feeding mechanisms 20 and yarn clipping mechanisms 30 and a plurality of color selection pressing plates 40 located between the two outer plates 60. Each of the color selection pressing plates 40 corresponds to one yarn feeding mechanism 20 and one yarn clipping mechanism 30. There is further a floss removing device 70 fastened to the outer plate 60 through a fastening element 90. A floss detent plate 80 also is provided on a upper side of the yarn feeding plate 21 that is exposed outside the spacer 50 to prevent floss from entering. The needle selection device (not shown in the drawings) can drive the color selection pressing plate 40 to release the corresponding yarn feeding mechanism 20 and the yarn clipping mechanism 30 so that the upper and lower cams of the circular knitting machines can separately control yarn feeding operation of the yarn feeding mechanism 20 and yarn clipping operation of the yarn clipping mechanism 30 to achieve high speed operation without dropping the yarns.

Figure 3:
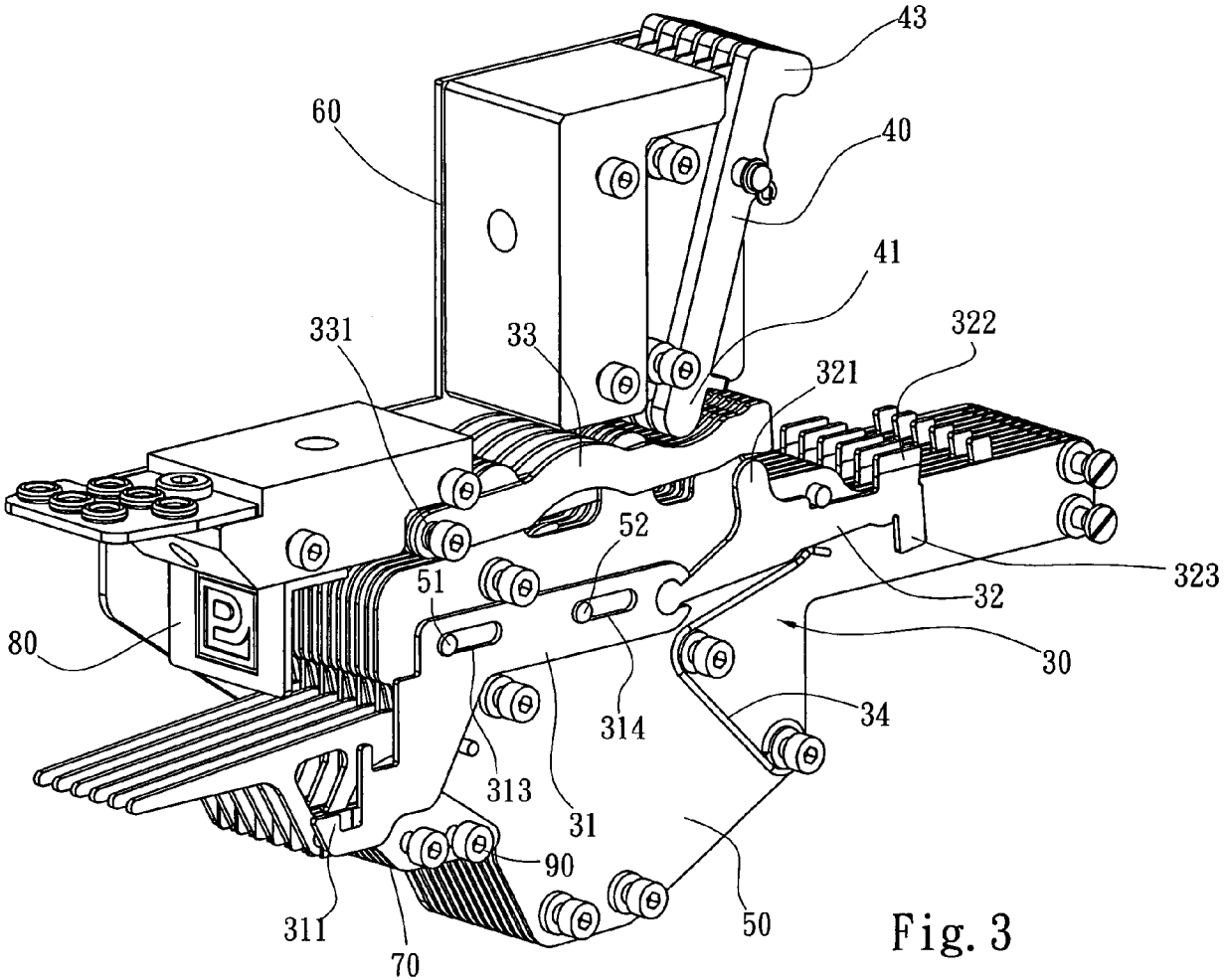
FIG. 3 is a fragmentary perspective view of the yarn clipping mechanism of the present invention.

Referring to FIG. 3, the yarn clipping mechanisms 30 of the invention are located between the two outer plates 60 among the yarn feeding mechanisms 20 in an alternate fashion to perform colored yarn clipping and severing operations. Each yarn clipping mechanism 30 includes a first action plate 33, a clipping yarn pushing plate 32, a clipping yarn plate 31 and an elastic element 34. The clipping yarn plate 31 is driven by the clipping yarn pushing plate 32. The first action plate 33 has one end pivotally coupled with the spacer 50 and another free end harnessed and pressed by the color selection pressing plate 40 and the clipping yarn pushing plate 32.

Figure 4:
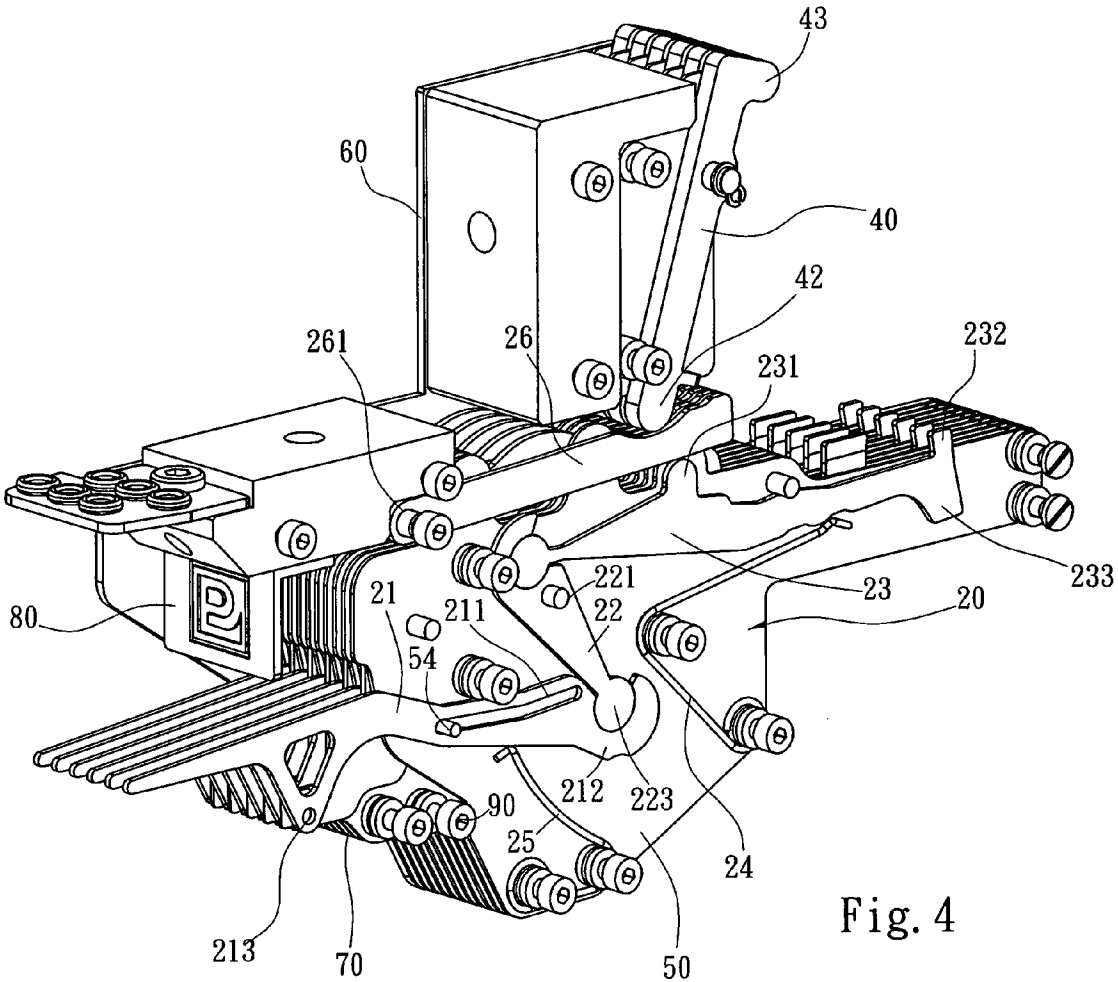
FIG. 4 is a fragmentary perspective view of the yarn feeding mechanism of the present invention.

Referring to FIG. 4, the yarn feeding mechanisms 20 are located between the two outer plates 60 to perform colored yarn feeding operation. Each yarn feeding mechanism 20 includes a second action plate 26, a feeding yarn pushing plate 23, a linkage bar 22, a yarn feeding plate 21 and two elastic elements 24 and 25. The yarn feeding plate 21 is driven by the feeding yarn pushing plate 23 through the linkage bar 22. The yarn feeding plate 21 has an action slot 211 run through by an anchor lug 54 of the spacer 50. The second action plate 26 has one end pivotally coupled with the spacer 50 and another free end harnessed and pressed by the color selection pressing plate 40 and the feeding yarn pushing plate 23.

Figure 5A:
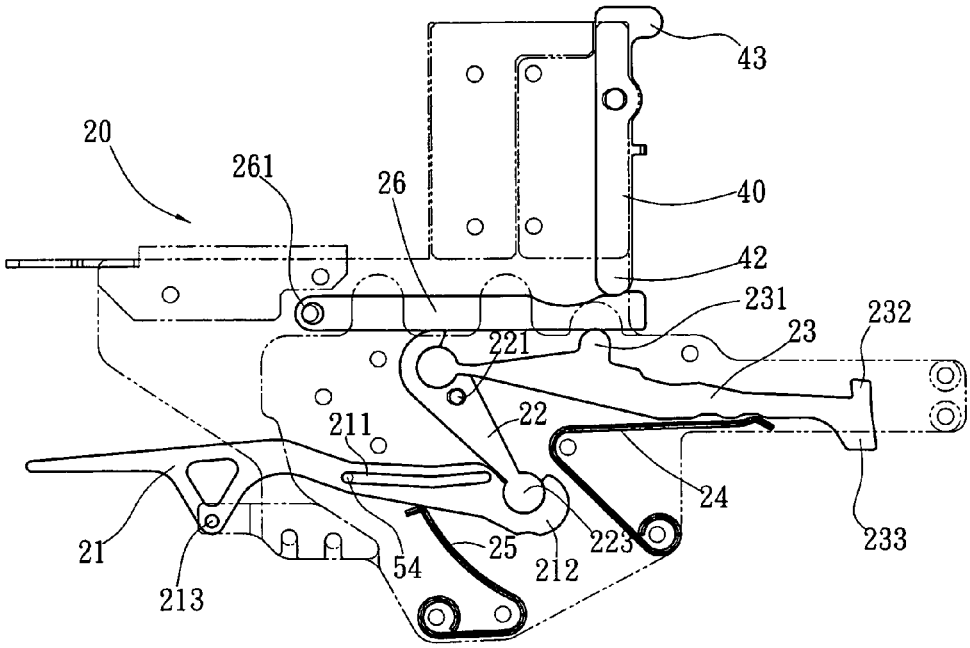
FIGS. 5A through 5H are schematic views of the color altering head of the present invention in operating conditions.
Figure 5B:
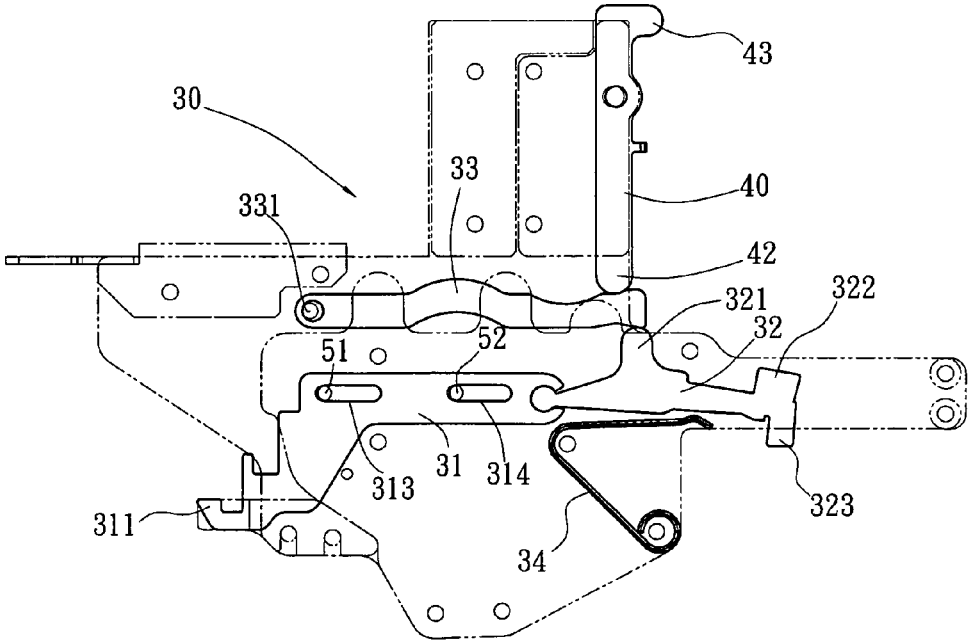
Figure 5C:
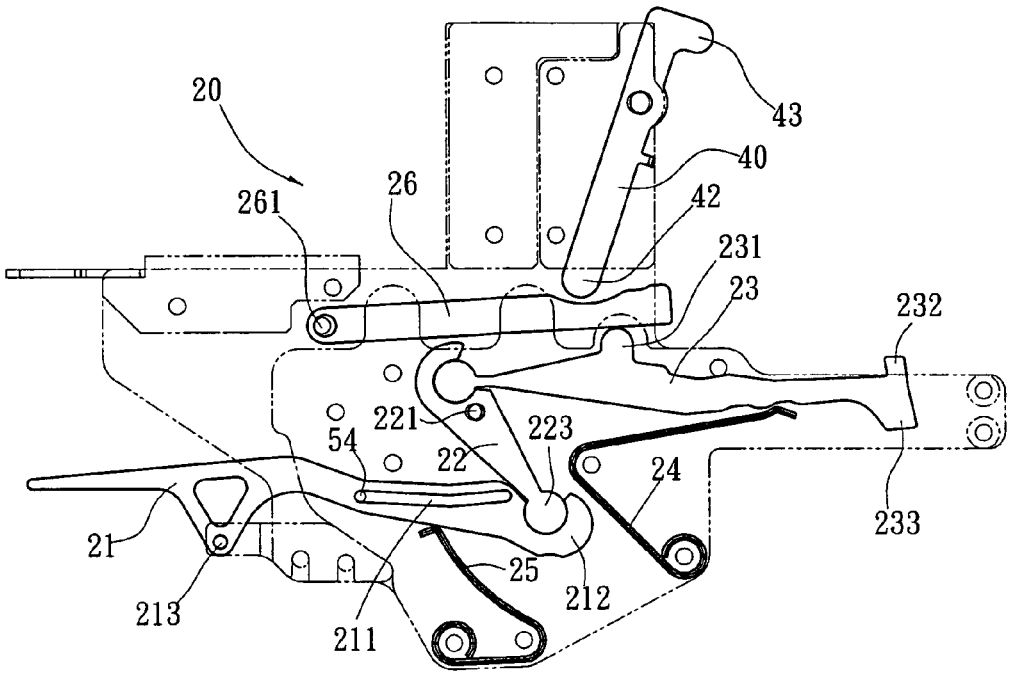
Figure 5D:
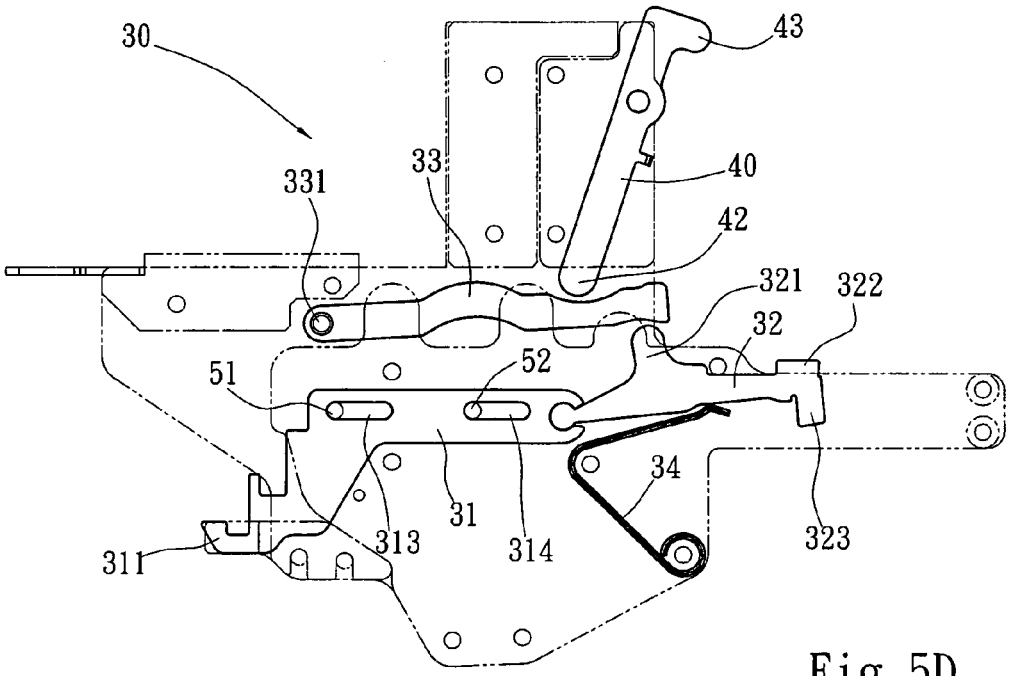
Figure 5E:
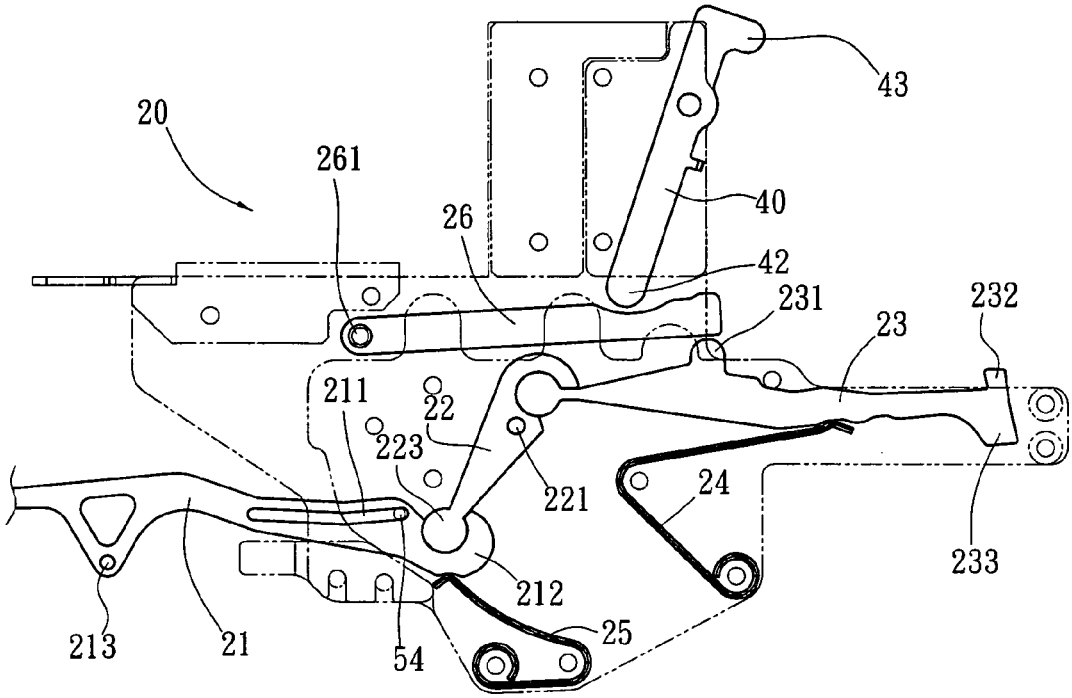
Figure 5F:
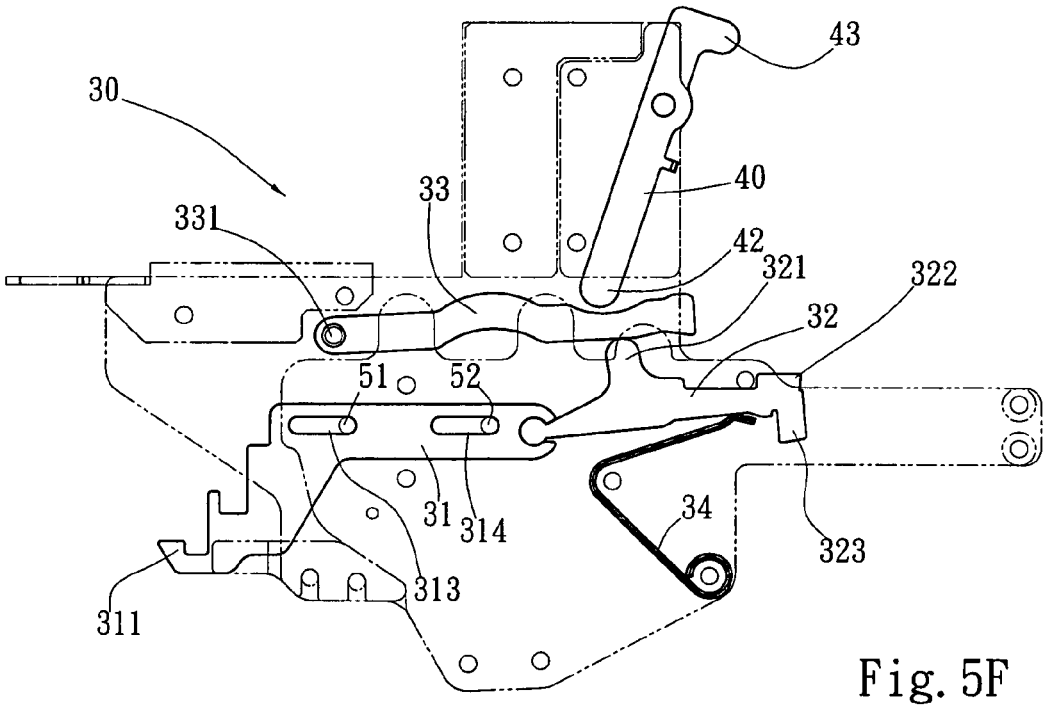
Figure 5G:
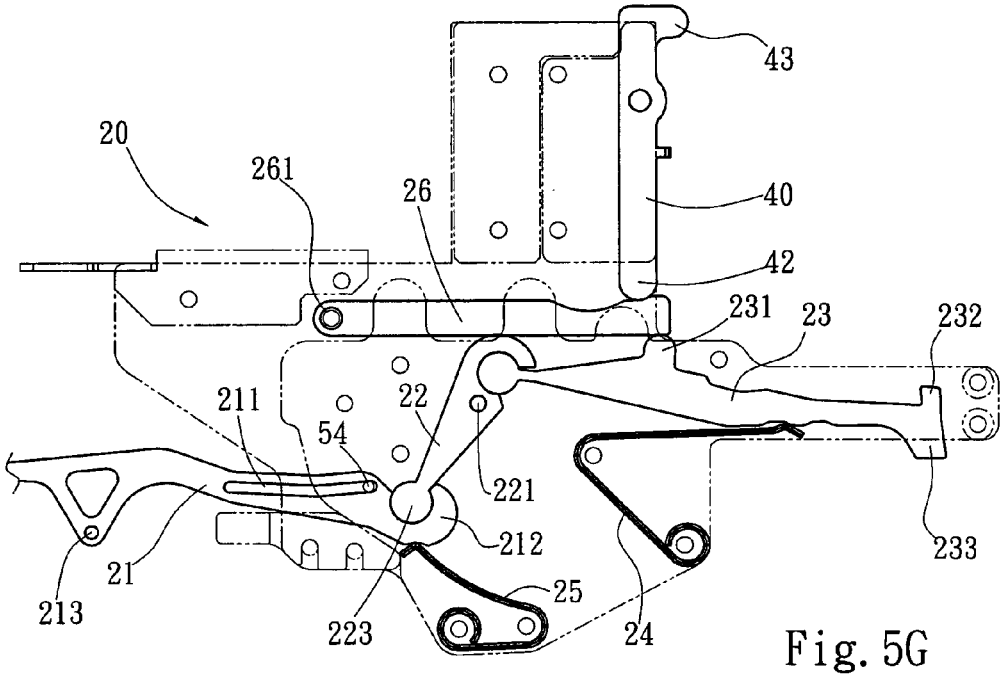
Figure 5H:
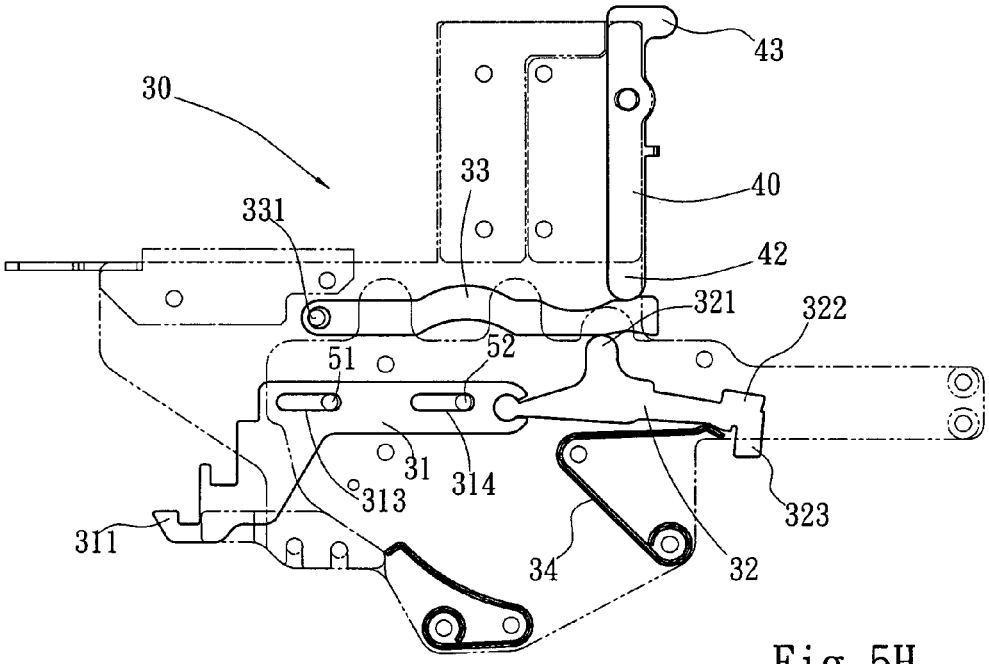

Refer to FIGS. 5A through 5H for the high speed color altering head 2 of the invention in operating conditions. The yarn feeding and severing operations are controlled by the upper and lower cams (not shown in the drawings). FIGS. 5A and 5B depict a condition in which the color selection pressing plate 40 is not yet driven by the needle selection device (not shown in the drawings), and the yarn feeding mechanism 20 and the yarn clipping mechanism 30 are in a return condition. The color selection pressing plate 40 pushes the second action plate 26 and the first action plate 33 through a thrust end 42, and the feeding yarn pushing plate 23 has a first detent portion 231 and the clipping yarn pushing plate 32 has a second detent portion 321 retained respectively by the second action plate 26 and the first action plate 33 without moving.

When a return end 43 of the color selection pressing plate 40 is driven by the needle selection device (not shown in the drawings) (referring to FIGS. 5C and 5D), the thrust end 42 of the color selection pressing plate 40 enables the second action plate 26 of the yarn feeding mechanism 20 to be pushed and moved by the feeding yarn pushing plate 23 about a first axis 261 while another end of the second action plate is the free end, and the first action plate 33 of the yarn clipping mechanism 30 to be pushed and moved by the clipping yarn pushing plate 32 about a second axis 331 while another end of the first action plate is the free end (with the pushing force generated by the elastic elements 24 and 34). Hence a first drawing portion 232 of the feeding yarn pushing plate 23 and a first thrust portion 322 of the clipping yarn pushing plate 32 are exposed outside the spacer 50 on a upper side. The first drawing portion 232 exposed outside the spacer 50 is driven by the upper cam (not shown in the drawings) of the circular knitting machine to move the linkage bar 22 rearwards. The linkage bar 22 moves about an axial hole 221 to sway the pivotal juncture of a pivot head 223 and a coupling portion 212 to move the yarn feeding plate 21 forwards along the action slot 211 to move the yarn outside (referring to FIG. 5E). Meanwhile, the first thrust portion 322 of the clipping yarn pushing plate 32 exposed outside the spacer 50 is driven forwards by another upper cam (not shown in the drawings) to move the clipping yarn plate 31. The clipping yarn plate 31 is moved forwards along a path defined by a first anchor point 51 and a first slot 313 and a second anchor point 52 and a second slot 314 to release the yarn at the front side (referring to FIG. 5F) to be used by the knitting needle (not shown in the drawings) of the circular knitting machine to perform knitting operation.

When the a return cam (not shown in the drawings) of the circular knitting machine is in contact with the color selection pressing plate 40 in the next rotation cycle, the color selection pressing plate 40 is returned and reset. While the color selection pressing plate 40 depresses the first drawing portion 232 of the feeding yarn pushing plate 23 into the spacer 50 to expose a second thrust portion 233 outside the spacer 50 on a lower side, and the first thrust portion 322 of the clipping yarn pushing plate 32 is pushed into the spacer 50 to expose a second drawing portion 323 outside the spacer 50 on the lower side, the yarn feeding plate 21 and the clipping yarn plate 31 are not moving (referring to FIGS. 5G and 5H). Another set of the yarn feeding mechanism (not shown in the drawings) and another set of the yarn clipping mechanism (not shown in the drawings) resume the aforesaid operations only when the needle selection device (not shown in the drawings) is changed to another colored yarn. Then another colored yarn is picked up and released for knitting operation. Meanwhile, the second thrust portion 233 of the feeding yarn pushing plate 23 exposed outside the spacer 50 is driven by the lower cam (not shown in the drawings) to drive the linkage bar 22 forwards, and the linkage bar 22 moves about an axial hole 221 to sway the pivotal juncture of the pivot head 223 and the coupling portion 212 to move the yarn feeding plate 21 along the moving path of the action slot 211 to move the yarn rewards (referring to FIG. 5A), and the colored yarn is straddled transversely on a clipping portion 311 of the clipping yarn plate 31 (not shown in the drawings). Meanwhile, due to the colored yarn is straddled transversely on the clipping portion 311, and the second drawing portion 323 of the clipping yarn pushing plate 32 is driven by the lower cam (not shown in the drawings), the clipping yarn plate 31 is moved rearwards to the spacer 50 (referring to FIG. 5B), and a shearing force is generated to sever the colored yarn, and the colored yarn is clipped between the clipping portion 311 and the spacer 50 (not shown in the drawings). Thus the yarns of different colors can be altered and knitted. And the resulting knitted fabric has colorful and jacquard effect.

Figure 6:
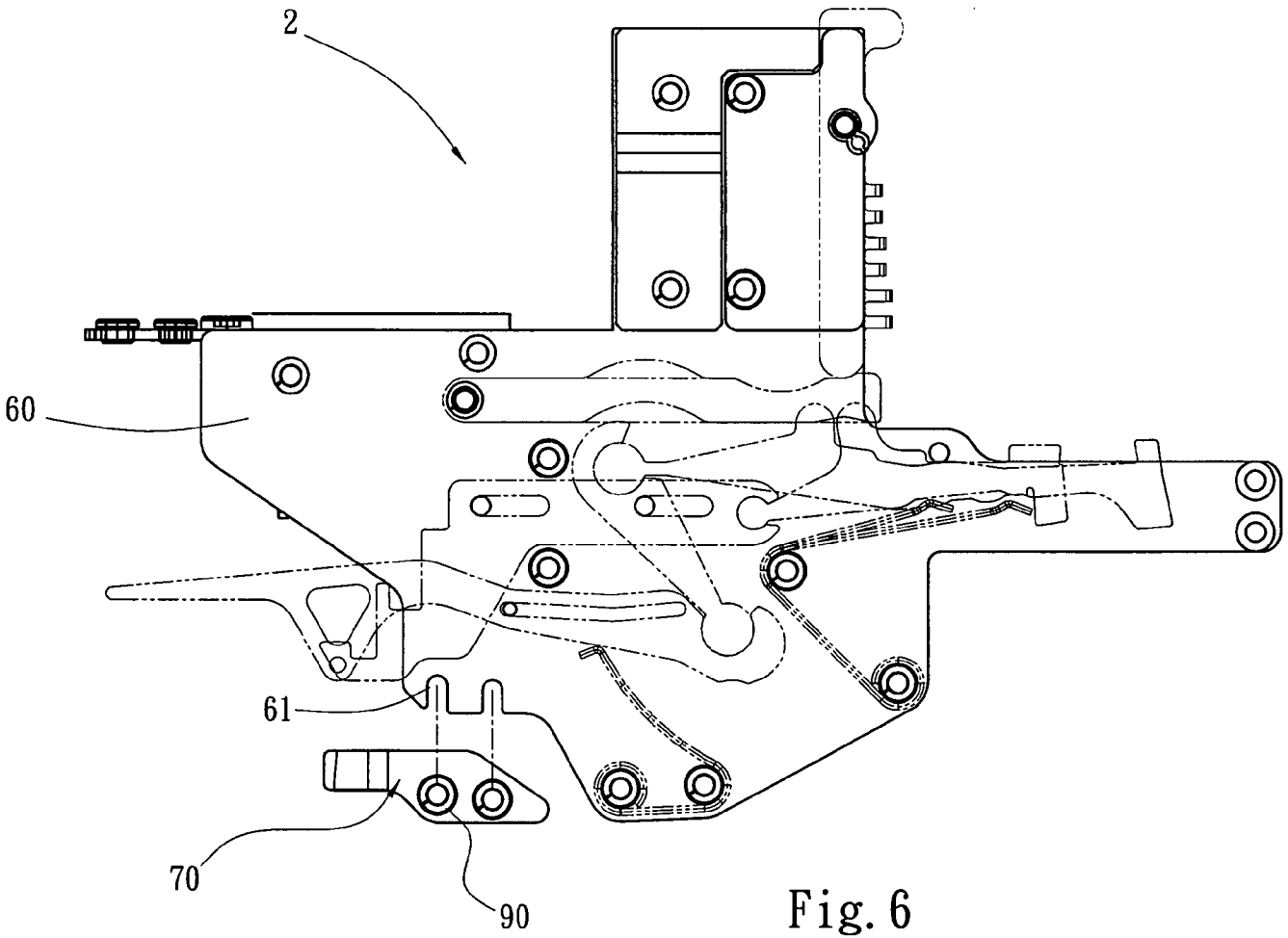
FIG. 6 is an exploded view of the floss removing device of the color altering head of the present invention.

Refer to FIG. 6 for an embodiment of a floss removing device 70 of the color altering head 2. The outer plate 60 has two notches 61 to fasten the floss removing device 70 through a fastening element 90 (such as a screw). It is located on the position where yarn severing and clipping take place on the clipping portion 311 of the yarn clipping mechanism 30, and the floss is accumulated easily. The floss removing device adopts a detachable design and enables the floss to be cleared easily and quickly.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A high speed color altering head for single-face circular knitting machines installed on a circular knitting machine and controlled by a return cam, a needle selection device and a upper cam and a lower cam of the circular knitting machine to perform colored yarn feeding operation and achieve colored and jacquard knitting effect, comprising:

two outer plates located on two outer sides of the color altering head;

a plurality of yarn feeding mechanisms located between the two outer plates to provide the colored yarn feeding operation;

a plurality of yarn clipping mechanisms located between the two outer plates among the yarn feeding mechanisms in an alternate fashion to clip and sever colored yarns;

a plurality of spacers located between the outer plates, the yarn feeding mechanisms and the yarn clipping mechanisms; and a plurality of color selection pressing plates located between the two outer plates, each color selection pressing plate corresponding to one yarn feeding mechanism and one yarn clipping mechanism;

wherein the color selection pressing plates are driven by the needle selection device to release the corresponding yarn feeding mechanisms and yarn clipping mechanisms so that the upper and lower cams control the yarn feeding operation of the yarn feeding mechanisms and yarn severing operation of the yarn clipping mechanisms at high speed without dropping the yarns.

2. The high speed color altering head of claim 1, wherein each of the yarn feeding mechanisms includes a second action plate, a feeding yarn pushing plate, a linkage bar, a yarn feeding plate and an elastic element, the yarn feeding plate being driven by the feeding yarn pushing plate through the linkage bar.

3. The high speed color altering head of claim 2, wherein each of the spacers has an anchor lug, the yarn feeding plate having a first action slot which is coupled with the anchor lug.

4. The high speed color altering head of claim 2, wherein the yarn feeding plate is exposed on a upper side of the spacer and has a floss detent plate to prevent floss from entering.

5. The high speed color altering head of claim 2, wherein the second action plate has one end pivotally coupled with the spacer and another free end harnessed and pressed by the color selection pressing plate and the feeding yarn pushing plate.

6. The high speed color altering head of claim 1, wherein each of the spacers has an anchor lug, a first anchor point and a second anchor point.

7. The high speed color altering head of claim 1, wherein the yarn clipping mechanism includes a first action plate, a clipping yarn pushing plate, a clipping yarn plate and an elastic element, the clipping yarn plate being driven by the clipping yarn pushing plate.

8. The high speed color altering head of claim 7, wherein the first action plate has one end pivotally coupled with the spacer and another free end pushed by the color selection pressing plate and the clipping yarn pushing plate.

9. The high speed color altering head of claim 7, wherein the outer plate has a notch to fasten a detachable floss removing device through a fastening element to clear floss, the floss removing device having intervals for said clipping yarn plate clipping operation, the number of the intervals being same as the spacers.

* * * * *